US011600908B2

(12) United States Patent
Fotheringham et al.

(10) Patent No.: US 11,600,908 B2
(45) Date of Patent: Mar. 7, 2023

(54) DEVICE, SYSTEM AND METHOD FOR PROVIDING A MODULAR ANTENNA ASSEMBLY

(71) Applicants: David Fotheringham, Redmond, WA (US); Adam Nonis, Redmond, WA (US); Tom Freeman, Redmond, WA (US); Mersad Cavcic, Redmond, WA (US); David Levesque, Redmond, WA (US)

(72) Inventors: David Fotheringham, Redmond, WA (US); Adam Nonis, Redmond, WA (US); Tom Freeman, Redmond, WA (US); Mersad Cavcic, Redmond, WA (US); David Levesque, Redmond, WA (US)

(73) Assignee: KYMETA CORPORATION, Redmond, WA (US)

( * ) Notice: Subject to any disclaimer, the term of this patent is extended or adjusted under 35 U.S.C. 154(b) by 56 days.

(21) Appl. No.: 15/377,954

(22) Filed: Dec. 13, 2016

(65) Prior Publication Data

US 2017/0187100 A1 Jun. 29, 2017

Related U.S. Application Data

(60) Provisional application No. 62/271,737, filed on Dec. 28, 2015.

(51) Int. Cl.
*H01Q 1/28* (2006.01)
*H01Q 21/00* (2006.01)
(Continued)

(52) U.S. Cl.
CPC ..... *H01Q 1/288* (2013.01); *H01Q 1/2291* (2013.01); *H01Q 1/3275* (2013.01);
(Continued)

(58) Field of Classification Search
CPC .... H01Q 1/288; H01Q 1/2291; H01Q 1/3275; H01Q 1/3283; H01Q 1/3291; H01Q 1/38;
(Continued)

(56) References Cited

U.S. PATENT DOCUMENTS 6,300,918 B1 10/2001 Riddle et al.
8,259,020 B1 9/2012 Macy
(Continued)

FOREIGN PATENT DOCUMENTS

CN 204118772 U 1/2015
CN 204517484 U 7/2015
(Continued)

OTHER PUBLICATIONS

International Search Report and Written Opinion from PCT/US2016/066990 dated Mar. 31, 2017, 11 pgs.
(Continued)

*Primary Examiner* — Anthony Q Edwards
*Assistant Examiner* — Hung Q Dang
(74) *Attorney, Agent, or Firm* — Womble Bond Dickinson (US) LLP

(57) ABSTRACT

Techniques and mechanisms to provide satellite communication functionality with an antenna assembly. In an embodiment, a communication device includes an antenna panel (comprising one or more holographic antenna elements), a housing and hardware interfaces which facilitate operation of the communication device has a module of the antenna display. A cross-sectional profile of the housing may conform to a polygon other than any rectangle. A configuration of the housing and hardware interfaces may facilitate the formation of an antenna assembly arrangement other than that of any rectilinear array. In another embodiment, communication devices of the antenna assembly each conform to a triangle or a hexagon.

18 Claims, 12 Drawing Sheets

(51) Int. Cl.

| | |
|---|---|
| ***H01Q 1/32*** | (2006.01) |
| ***H01Q 1/40*** | (2006.01) |
| ***H01Q 1/38*** | (2006.01) |
| ***H01Q 1/22*** | (2006.01) |
| ***H01Q 1/42*** | (2006.01) |
| ***H01Q 19/06*** | (2006.01) |

(52) U.S. Cl.
CPC ..... *H01Q 1/3283* (2013.01); *H01Q 1/3291* (2013.01); *H01Q 1/38* (2013.01); *H01Q 1/405* (2013.01); *H01Q 1/42* (2013.01); *H01Q 19/067* (2013.01); *H01Q 21/0025* (2013.01); *H01Q 21/0031* (2013.01)

(58) Field of Classification Search
CPC ..... H01Q 1/405; H01Q 1/42; H01Q 19/067; H01Q 21/0025; H01Q 21/0031; H01Q 1/246; H04B 7/0408; H04B 7/0617; H04B 7/18513; H04B 7/18523; H04W 16/24; H04W 16/28; H04W 88/085; H04W 88/08; H04W 88/02; H04M 2250/12; H04M 1/72522; H04H 20/51; H04H 20/74; H04H 40/90; H04H 2201/14; H04H 2201/19; H04N 7/20
See application file for complete search history.

(56) References Cited

U.S. PATENT DOCUMENTS

| | | | | |
|---|---|---|---|---|
| 8,749,446 | B2 | 6/2014 | Manry, Jr. et al. | |
| 8,872,719 | B2 * | 10/2014 | Warnick | H01Q 21/0025 343/853 |
| 9,293,802 | B2 * | 3/2016 | Voss | H01Q 1/02 |
| 2006/0176843 | A1 * | 8/2006 | Gat | H04B 7/18523 370/316 |
| 2008/0036668 | A1 * | 2/2008 | White | H01Q 1/38 343/745 |
| 2009/0231186 | A1 | 9/2009 | Barak et al. | |
| 2010/0029198 | A1 | 2/2010 | Hules et al. | |
| 2010/0099370 | A1 | 4/2010 | Nichols et al. | |
| 2010/0218224 | A1 | 8/2010 | Gat et al. | |
| 2013/0050034 | A1 * | 2/2013 | Wu | H01Q 1/42 343/713 |
| 2014/0139400 | A1 | 5/2014 | Voss et al. | |
| 2015/0079914 | A1 | 5/2015 | Takahashi et al. | |
| 2015/0171512 | A1 | 6/2015 | Chen et al. | |
| 2015/0171516 | A1 | 6/2015 | Chen et al. | |
| 2015/0236412 | A1 | 8/2015 | Bily et al. | |
| 2015/0288063 | A1 | 10/2015 | Johnson | |
| 2015/0358930 | A1 * | 12/2015 | Navalekar | H04W 56/001 370/281 |
| 2016/0233588 | A1 | 8/2016 | Bily et al. | |

FOREIGN PATENT DOCUMENTS

| | | |
|---|---|---|
| JP | 2002-090444 | 3/2002 |
| JP | 2002090444 | 3/2003 |
| JP | 2014107789 | 6/2014 |
| JP | 2015-080031 | 4/2015 |
| JP | 2015080031 | 4/2015 |

OTHER PUBLICATIONS

Phasor, "Connectivity Demands" Retrieved Dec. 13, 2016, from http://www.phasorsolutions.com/connectivity-demands.
Mayo, Richard et al., "A cost-effective modular phased array." 2013 IEEE International Symposium on Phased Array Systems and Technology, IEEE, Oct. 12, 2013, 4 pages.
Lindseth, Brad et al., "Wind Profiler Radar Antenna Sidelobe Reduction." IEEE Transactions on Antennas and Propagation, IEEE Service Center, Piscataway, NJ, US, Jan. 1, 2014, 8 pages.
European Search Report for Application No. 16882332.6-1205/3398231 PCT/US2016056986 dated Jul. 12, 2019, 11 pages.
International Preliminary Report on Patentability received for PCT Patent Application No. PCT/US2016/066986, dated Jul. 12, 2018, 8 pages.
Taiwan Office Action dated Jun. 25, 2019, 3 pages.
Japanese Office Action for Application 2018-533805 dated Aug. 22, 2019 5 pages.
Korean Office Action for Application No. 10-2018-7021787, dated Oct. 21, 2019, 9 pages.
Indian First Examination Report for Application No. 201847022354 dated Jan. 17, 2020, 6 pages.
Chinese Office Action for Application No. 201680076660.5 dated May 28, 2020, 15 pages.
Taiwanese Office Action on the Patentability of Application No. 105142657, dated Oct. 23, 2020, 2 pages.
Taiwanese Office Action and Search Report on the Patentability of Application No. 105142657, dated Mar. 31, 2021, 14 pages.
Taiwanese Office Action and Search Report on the Patentability of Application No. 105142657 dated Oct. 28, 2021, 15 pages.

* cited by examiner

DEVICE, SYSTEM AND METHOD FOR PROVIDING A MODULAR ANTENNA ASSEMBLY

CROSS-REFERENCE TO RELATED APPLICATIONS

This application claims the benefit of U.S. Provisional Application No. 62/271,737, filed on Dec. 28, 2015, the entire contents of which are hereby incorporated by reference herein.

BACKGROUND

1. Technical Field

Embodiments of the present invention relate to the field of antennas and more particularly, but not exclusively, relate to an assembly of modular antenna devices.

2. Background Art

Existing satellite systems usually include the use of dish systems that are designed to be mounted on a stand, with the horn pointing in at the dish surface. These and other satellite communication technologies occupy somewhat large footprints and tend to be inflexible in terms of system requirement.

Wireless technologies, such as those for satellite communication, continue to grow in number, variety and capability. The continually-changing nature of these technologies poses challenges for some use cases. For example, there is an increasing demand for the automotive industry to provide in-vehicle solutions to support, replace or supplement the use of consumer smartphones and on-board cellular technology modules. However, cars and trucks are expected to have a useful lifespan of approximately ten years. This is problematic, since communications systems often become outdated well before the end of a vehicle's useful lifespan. Moreover, automobiles vary significantly between each other. For at least these reasons, the automotive industry is one example of a market which can benefit from satellite communication solutions that are flexible in design and resource efficient.

BRIEF DESCRIPTION OF THE DRAWINGS

The various embodiments of the present invention are illustrated by way of example, and not by way of limitation, in the figures of the accompanying drawings and in which.

DETAILED DESCRIPTION

Embodiments described herein variously provide techniques and/or mechanisms to enable efficient satellite communications with an assembly of modular communication devices. A communication device according to one embodiment may comprise a housing, one or more antenna elements disposed therein, and one or more hardware interfaces to facilitate operation of the one or more antenna elements. Some or all such one or more antenna elements may provide holographic antenna functionality and/or may be integrated with a planar structure (referred to herein as an "antenna panel") that accommodates a low-profile form factor. In one example embodiment, some or all of the antenna panel is fabricated using a thin film transistor (TFT) manufacturing process. Alternatively or in addition, the antenna panel may provide for an electronically steerable transmit and/or receive functionality.

A configuration of the communication device—e.g., including a shape of the housing and/or a configuration of the one or more hardware interfaces in or on respective sides of the housing—may facilitate coupling of the communication device as part of an assembly including multiple similarly-configured communication devices. For example, a cross-sectional profile of the housing may conform to a polygon—other than a rectangle (e.g., other than a square)—that allows for tessellation with one or more other communication devices' housing, each of which also conforms to such a polygon. Certain features of various embodiments are described herein with reference to a communication device comprising a housing which conforms to a hexagon. However, such description may be extended to additionally or alternatively apply to communication devices having any of variety of other tileable shapes.

Figure 1A:
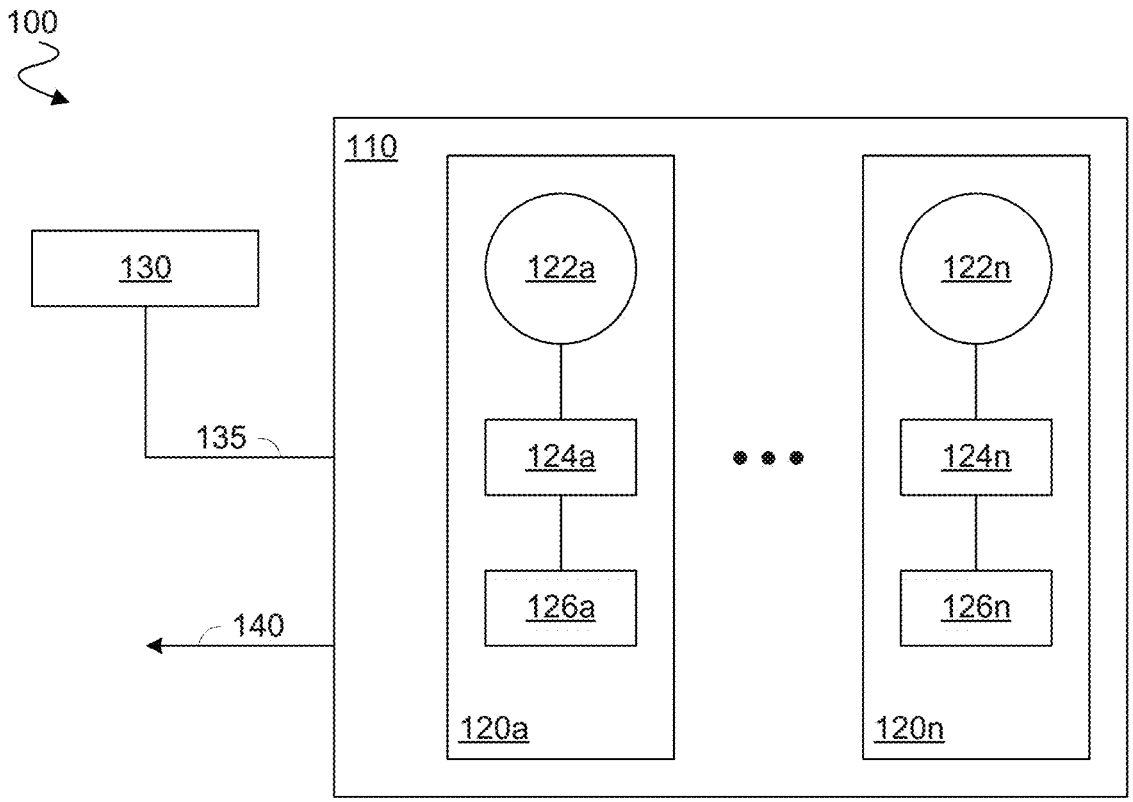
FIG. 1A is a block diagram illustrating features of a system to perform satellite communication according to an embodiment.

FIG. 1A illustrates elements of a system 100 to provide satellite communication according to an embodiment. System 100 is one example of an embodiment wherein satellite communication functionality is to be provided with an assembly (for brevity, referred to herein as an "antenna assembly") of modular communication devices—e.g., the assembly having an arrangement other than that of any rectilinear array.

In the illustrative embodiment shown, system 100 includes an assembly 110 of communication devices (e.g., including the illustrative communication devices 120*a*, . . . , 120*n* shown) and circuitry 130 coupled to assembly 110 via an interconnect 135. Assembly 110 may receive via interconnect 135 a supply voltage from a battery or other power supply that is included in, or coupled to, circuitry 130. Such a supply voltage may facilitate communication using one or more communication devices of assembly 110. For example, communication devices 120*a*, . . . , 120*n* may include respective antenna panels 122*a*, . . . , 122*n* and circuitry 124*a*, . . . , 124*n* coupled to antenna panels 122*a*, . . . , 122*n*, respectively. Interconnect 135 may be coupled to provide power (directly or indirectly) to some or all of respective hardware interfaces 126*a*, . . . , 126*n* of communication devices 120*a*, . . . , 120*n*—e.g., where such power enables circuitry 124*a*, . . . , 124*n* to control respective antenna elements of antenna panels 122*a*, . . . , 122*n*.

Some of all of antenna panels 122*a*, . . . , 122*n* may each include one or more respective holographic antenna elements that variously enable high data throughput communications with an in-orbit satellite. Such communication may be based on data having a format that is compatible with a Transmission Control Protocol/Internet Protocol (TCP-IP), User Datagram Protocol (UDP) or any of a variety of other communication protocols which accommodate digital data exchanges via an Internet. Alternatively or in addition, such satellite communications may be simplex, half-duplex or full duplex, for example. A bandwidth supported by some or all of communication devices 120*a*, . . . , 120*n* may be sufficient for applications with higher throughput requirements than those for audio streaming—e.g., wherein assembly 110 operates to facilitate software updates, high definition video streams and/or the like.

In some embodiments, digital signals and/or analog signals may be communicated between circuitry 130 and assembly 110. For example, circuitry 130 may include any of a variety of integrated circuit devices (e.g., including a processor, application specific integrated circuit, controller and/or the like) to provide via one or more signal lines of interconnect 135 digital signals representing data which assembly 110 is to transmit to a satellite. Alternatively or in addition, circuitry 130 may receive via one or more signal lines of interconnect 135 digital signals representing data which assembly 110 has received from a satellite. Although some embodiments are not limited in this regard, system 100 may further comprise one or more waveguides to communicate analog signals to or from assembly 110—e.g., wherein the illustrative waveguide 140 shown is coupled to output an analog signal representing data received from a satellite. In some embodiments, communication devices 120*a*, . . . , 120*n* include one communication device which is only indirectly coupled to circuitry 135 via another one of communication devices 120*a*, . . . , 120*n*. Alternatively, communication devices 120*a*, . . . , 120*n* may each be coupled to circuitry 130, via a different respective interconnect, independent of any other of communication devices 120*a*, . . . , 120*n*.

Although represented as functional blocks, communication devices 120*a*, . . . , 120*n* may each have a respective cross-sectional profile that conforms to a polygon other than any rectangle. For example, antenna panel 122*a* may be surrounded (at least in one plane) by a housing of communication device 120*a*, where at least some distinct flat side portions of the housing are variously oblique to each other, and where flat side portions conform each to a different respective side of a non-rectangular polygon. In such an embodiment, some or all other communication devices of assembly 110 may similarly conform to the same non-rectangular polygon. The respective cross-sectional profiles of communications devices 120*a*, . . . , 120*n*—e.g., in combination with the various locations of hardware interfaces 126*a*, . . . , 126*n* each in or on a respective side of one of communications devices 120*a*, . . . , 120*n*—may enable an arrangement of assembly 110 other than that of a rectilinear array.

Figure 1B:
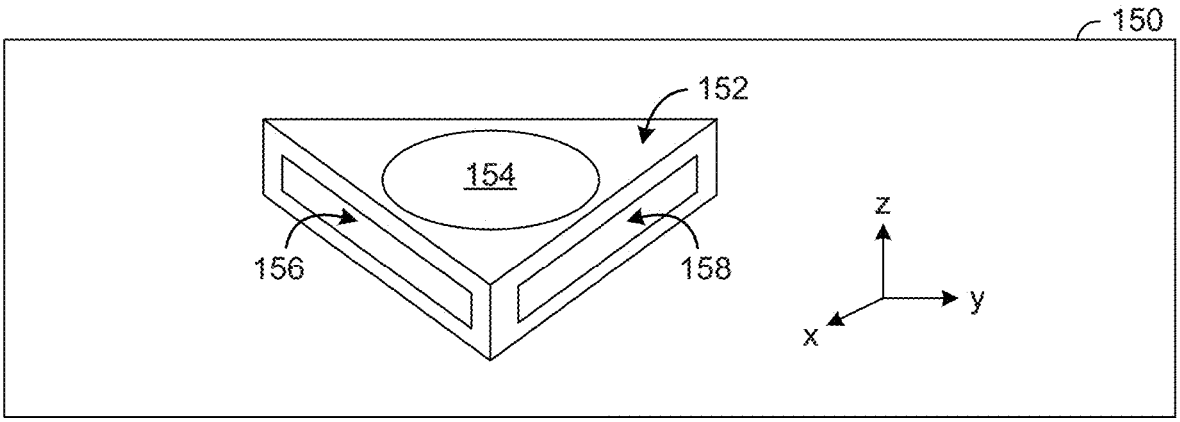
FIG. 1B is a perspective view diagram illustrating elements of a communication device according to an embodiment.

For example, FIG. 1B shows a communication device 150 providing functionality to operate as one module of an antenna assembly according to an embodiment. Communication device 150 may have some or all of the features of one of communication devices 120*a*, . . . , 120*n*, for example. In the illustrative embodiment shown, communication device 150 includes an antenna panel 154 and a housing 152 which extends around at least a portion of antenna panel 154. The housing 152 may comprise any of a variety of plastic, metal or other materials used in laptops, tablets etc. to protect and structurally support circuit components. Housing 152 may form an aperture structure through which signals are communicated using antenna panel 154. A cross-sectional profile of communication device 150 (e.g., the cross-section in parallel with the x-y plane of the x-y-z coordinate system shown) may conform, for example, to a triangle or other non-rectangular polygon.

Hardware interfaces of communication device 150 may be variously positioned in or on housing 152 to accommodate coupling of communication device 150 to two or more other devices including, for example, at least one other similarly configured communication device. By way of illustration and not limitation, communication device 150 may include hardware interfaces 156, 158 which are variously disposed each in or on a respective side of housing 152 (e.g., other than a side by which antenna panel 154 is to communicate signals with a satellite). At least one of hardware interfaces 156, 158 may include connector structures which facilitate connection of communication device 150 to another such communication device—e.g., where hardware interface 156 is reciprocal to hardware interface 158. For example, respective hardware interfaces of the two communication devices may be coupled to one another directly or via an adapter, a short (e.g., less than 20 centimeters) interconnect cable or the like. Such coupling may facilitate the communication of a supply voltage, digital signals and/or analog signals, for example.

Figure 1C:
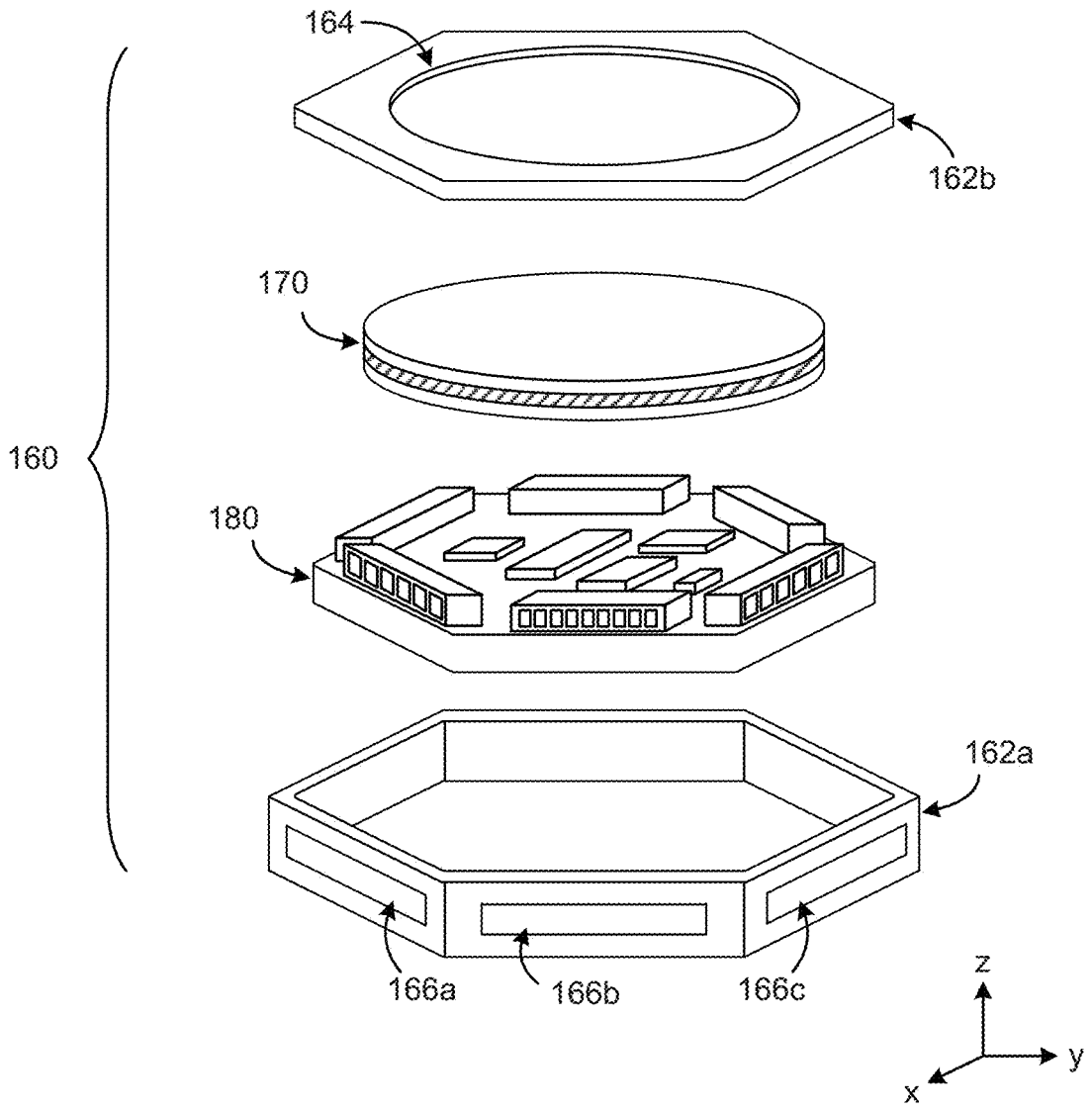
FIG. 1C is an exploded view diagram illustrating elements of a device to facilitate satellite communication according to an embodiment.

FIG. 1C shows an exploded view of a device 160 to facilitate satellite communications according to an embodiment. Device 160 may include some or all of the features of one of communication devices 120*a*, 120*n*, 150, for example. Device 160 is one example of an embodiment including a housing which surrounds a volume—e.g., in at least one plane—wherein an antenna panel is disposed in said volume. A configuration of device 160 may facilitate coupling of device 160 as one module in an antenna assembly comprising multiple communication devices. In the example embodiment shown, device 160 includes a housing formed, for example, by portions (e.g., including the illustrative housing portions 162*a*, 162*b* shown) that meet to surround at least part of an antenna panel 170.

Antenna panel 170 may comprise one or more holographic antenna elements operable to participate in a satellite communication. Such communication may, for example, include antenna panel 170 communicating signals in a frequency range which includes frequencies greater than 7.5 GigaHertz (GHz)—e.g., wherein the frequency range includes at least 10 GHz. By way of illustration and not limitation antenna panel 170 may communicate Ku band signals (in a 12 GHz to 18 GHz range), Ka band signals (in a 26.5 GHz to 40 GHz range), Q band signals (in a 33 GHz to 50 GHz range), V band signals (in a 40 GHz to 75 GHz range) or the like. Alternatively or in addition, communications with antenna panel 170 may include transmission or reception of signals representing or otherwise corresponding to TCP-IP packets and/or any of a variety of other packetized data which is compatible with an Internet communication protocol.

In the illustrative embodiment shown, antenna panel 170 is aligned with an aperture structure 164 which is formed (e.g., by housing portion 162*b*) at a side of the housing, the aperture structure 164 to accommodate signal communication, via said side of the housing, between antenna panel 170 and a remote satellite (not shown). The housing may form, or be configured to couple to, a radome structure (not shown) which is at least partially transparent to signals communicated using antenna panel 170. Such a radome may provide antenna panel 170 with environmental protection and/or may mitigate distortion of a radiated signal pattern. The structure of the radome—e.g., including its composition, thickness or shape—may mitigate absorptive loss in the radome and/or signal reflections returning to antenna panel 170. In an embodiment, the radome includes one or more materials having low dielectric constant and low loss tangent properties. Any of a variety of materials used in conventional radome design may be adapted into some embodiments. Examples of such materials include, but are not limited to, any of a variety of thermoplastics (e.g., polycarbonate, polystyrene, polyetherimide, etc.), fiber reinforced composites (e.g., E-glass fabric with epoxy or polyester resins), and low dielectric glass (monolithic or laminated). However, some embodiments are not limited to a particular type of radome shape and/or radome material.

Antenna panel 170 may include some or all of an electronically steerable antenna array that, for example, provides configurable holographic antenna functionality and/or is fabricated utilizing a thin-film transistor (TFT) manufacturing process. For example, the antenna panel 170 may function as a holographic antenna that (as compared to phased array antennas, for example) enables relatively low-power operation and/or outputs less heat during such operation. By way of illustration and not limitation, satellite communication may be powered by a universal serial bus (USB) connector—e.g., compatible with the USB 2.0 standard, USB 3.0 standard or USB 3.1 standard developed by the USB Implementers Forum (USB IF)—coupled between antenna panel 160 and circuitry 130. TFT processes may allow for a reduction of overall depth of antenna structures—e.g., as compared to thicknesses seen in other antenna technologies. Alternatively or in addition, such antenna structures may provide high throughput connectivity solution (e.g., to support broadband data rates) and/or may have relatively low power requirements. Embodiments which provide low profile, low power, low heat and/or high throughput solutions may be particularly well suited to operation in a confined space (e.g., not more than five inches thick) of a vehicle.

Although some embodiments are not limited in this regard, communication using antenna panel 170 may result in, be based on and/or coincide with additional communications between device 160 and one or more other devices. For example, communication device 160 may facilitate wired communication and/or wireless communication with a device having some of all of the features of circuitry 130. Alternatively or in addition, communication device 160 may be coupled, communicatively or otherwise, to one or more other communication devices of an antenna assembly. Device 160 may further comprise circuitry 180 coupled to enable operation of antenna panel 170. By way of illustration and not limitation, circuitry 180 may include one or more printed circuit boards having passive circuit components and/or active circuit components (e.g., including one or more integrated circuit packages) variously disposed therein or thereon.

One or more interfaces of device 160—e.g., including the illustrative hardware interfaces 166*a*, 166*b*, 166*c* shown—may include respective connector structures to facilitate coupling of device 160 to an external power supply (not shown). A supply voltage provided by such a power supply may directly power operation of circuitry 180 and/or may charge a battery which is included in or coupled to supply circuitry 180. Circuitry 180 may further comprise one or more components to facilitate wired communication and/or wireless communication between device 160 and one or more other devices (e.g., other than a satellite). For example, hardware interfaces 166*a*, 166*b*, 166*c* may include a connector to couple to a waveguide for communicating a signal to or from antenna panel 170. Alternatively or in addition, the one or more interfaces may communicate packetized digital data which is based on (or is to be converted into) an analog signal received by (or to be transmitted by) antenna panel 170.

Hardware interfaces of communication device 160 may be variously positioned in or on respective sides of the housing to accommodate coupling of communication device 160 to two or more other devices including, for example, at least one other similarly configured communication device. By way of illustration and not limitation, hardware interfaces 166*a*, 166*b*, 166*c* may be variously disposed each in or on a respective side other than the side including aperture structure 164. At least one of hardware interfaces 166*a*, 166*b*, 166*c* may include connector structures which facilitate connection of communication device 160 to another such communication device—e.g., where one of hardware interfaces 166*a*, 166*b*, 166*c* is reciprocal to another of hardware interfaces 166*a*, 166*b*, 166*c*.

In an embodiment, circuitry 180 provides functionality to detect the presence of one or more other communication devices of an antenna assembly comprising device 160. For example, one or more packaged IC devices of circuitry 180 may operate to participate in handshake communications—e.g., compatible with a network discovery protocol—via some or all of hardware interfaces 166*a*, 166*b*, 166*c*. Such communications may exchange or otherwise disseminate information in the antenna assembly—e.g., the information including communications device identifiers, capability information and/or the like. Based on such communications, circuitry 180 (or another device coupled to device 160) may identify a relative configuration of devices in the antenna assembly. For example, devices may variously identify themselves to one another as being a closest neighboring devices along a particular series of connected devices. Based on such identification, control logic of circuitry 130 (and/or circuitry of one of communication devices 120*a*, . . . , 120*n*) may compile data describing an arrangement of devices in rows, columns, cells and/or other portions of an antenna array. In one embodiment, circuitry 180 participates in arbitration or other processes of the antenna assembly to determine which communication device is to control one or more other communication devices of the antenna assembly. One such device may be designated as a master device, where some or all other communication devices of the antenna assembly are to function as slaves of the master device. The designated master device may control beamforming, electronic beam steering, signal tracking and/or other processes of the antenna assembly.

Figure 2:
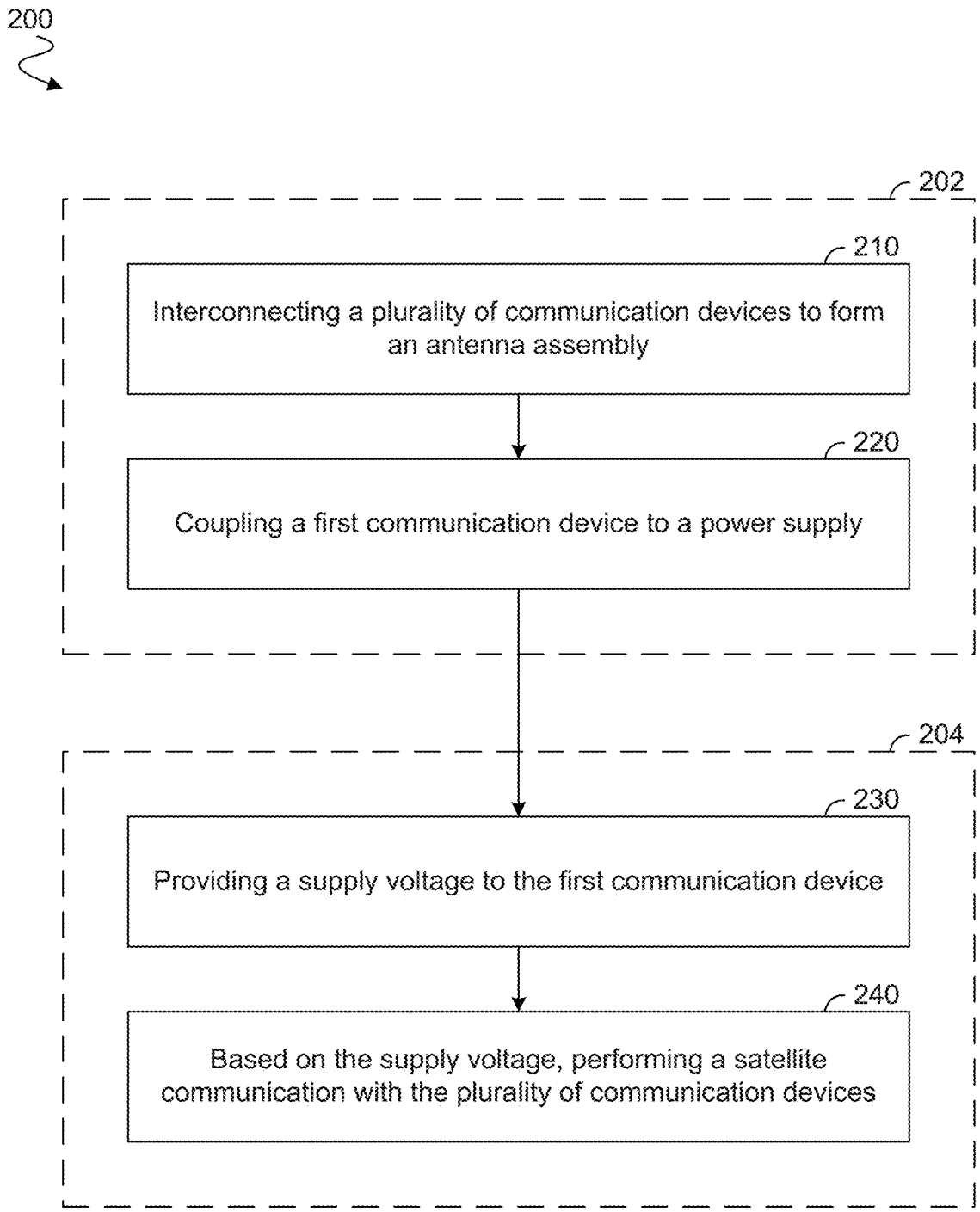
FIG. 2 is a flow diagram illustrating elements of a method for providing satellite communication functionality according to an embodiment.

FIG. 2 shows various operations that may be included in a method 200 to provide satellite communication functionality according to an embodiment. Method 200 may include or otherwise enable operation of system 100, for example. In one embodiment, method 200 provides communication functionality with an assembly of communication devices which have features of one of communication devices 120*a*, 120*n*, 150, 160.

Method 200 may include operations 202 to configure an antenna assembly for subsequent operation. For example, operations 202 may include, at 210, interconnecting a plurality of communication devices with one another, the interconnecting to form an antenna assembly. Some or all communication devices of the antenna assembly (e.g., including communication devices 120*a*, . . . , 120*n*) may each have a respective cross-sectional profile which conforms to a polygon—such as an equilateral triangle or a hexagon—other than any rectangle. The interconnecting at 210 may include coupling two communication devices to one another (e.g., via respective hardware interfaces thereof) directly or, alternatively, via an adapter, cable or other interconnect.

Operations 202 may further comprise, at 220, coupling a first communication device of the antenna assembly to a power supply. In one embodiment, a car or other vehicle includes the power supply—e.g., wherein the antenna assembly is disposed between an exterior surface of the vehicle and an interior surface of the vehicle. The coupling may be via an cable or other interconnect that, for example, is further to facilitate communication between the antenna assembly and external circuitry that, for example, is to function as a source of digital signals and/or a sink for digital signals. For example, data source circuitry may provide to the antenna assembly digital data which is then to be processed and converted to an analog signal for transmission to a satellite. In some embodiments, operations 202 further comprise coupling the antenna assembly to a waveguide. Such a waveguide may thus be coupled to communicate an analog signal which is to be transmitted by one or more antenna panels of the antenna assembly. Alternatively or in addition, the waveguide may be coupled to receive from the antenna assembly an analog signal received with such one or more antenna panels.

In some embodiments, method 200 additionally or alternatively includes operations 204 to operate an antenna assembly such as one which is configured, for example, by some or all of operations 202. For example, operations 204 may include, at 230, providing a supply voltage to the antenna assembly with a power supply such as the one coupled at 220. In some embodiments, operations 204 further comprise (at 240) performing a satellite communication, based on the supply voltage, with one or more antenna panels of the antenna assembly.

Referring again to FIG. 1A, devices 120*a*, . . . , 120*n* may receive—e.g., from circuitry 130—power that then is variously applied to some or all of circuitry 124*a*, . . . , 124*n* to enable operation of antenna panels 122*a*, . . . , 122*n*. By way of illustration and not limitation, circuitry 124*a* (or circuitry 124*n*, for example) may include some or all of a modem, antenna controller, and transceiver logic. In such an embodiment, the modem may convert internet protocol information (for example), provided by circuitry 130, into a format which is compatible with a satellite communication protocol. The resulting formatted signal may be amplified through the transceiver and converted by antenna panels 122*a*, . . . , 122*n* into radio wave energy that is then transmitted from system 100.

Alternatively or in addition, radio wave energy from a satellite may be received via antenna panels 122*a*, . . . , 122*n* and down converted to a signal which is compatible with the satellite protocol. Such a converted signal may be provided to the modem—e.g., for demodulation, conversion into an IP protocol and/or the like—prior to communication to a sink which (for example) is part of or coupled to circuitry 130.

Figure 3A:
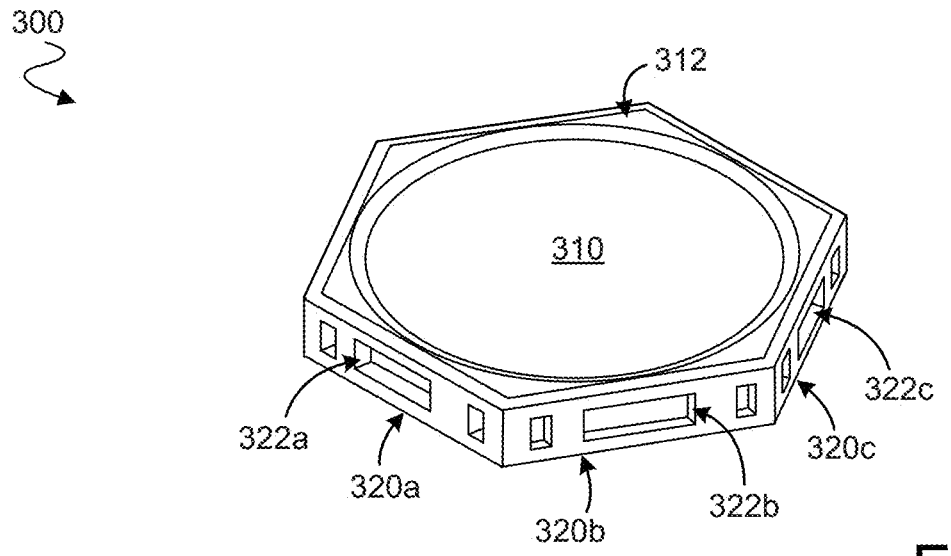
FIG. 3A is a perspective view diagram illustrating elements of a communication device according to an embodiment.

FIG. 3A illustrates a device 300 to provide satellite communication according to an embodiment. Device 300 may have some or all of the features of one of devices 120*a*, 120*n*, 150, 160, for example. In an embodiment, one or more operations of method 200 include or otherwise enable operation of device 300.

Device 300 is one example of an embodiment wherein a communication device is configured to accommodate connection and operation as one module in an assembly comprising multiple similarly configured communication devices. For example, a housing of the communication device may have a cross-sectional profile, side portions of which variously conform each to a different respective side of a polygon (in this example, a hexagon) other than a rectangle.

In the illustrative embodiment shown, device 300 includes a housing 312 which extends around an antenna panel 310 (e.g., antenna panel 170), wherein housing 312 forms multiple sides (e.g., including the illustrative sides 320*a*, 320*b*, 32*c* shown). Connector structures 322*a*, 322*b*, 322*c* of device 320 may be variously disposed each in or on a respective one of sides 320*a*, 320*b*, 32*c*. In such an embodiment, structures 322*a*, 322*b*, 322*c* may provide functionality of hardware interfaces 166*a*, 166*b*, 166*c*—e.g., to facilitate communication of a supply voltage to power communication using antenna panel 310. Alternatively or in addition, some or all of structures 322*a*, 322*b*, 322*c* may each one or more respective mounting structures—e.g., including any of a variety of brackets, slots, clips, rails, tabs, holes, threading and/or the like—to facilitate a securing of device 300 to another communication device of the antenna assembly and/or to a structure which is to mechanically support such an antenna assembly.

Figure 3B:
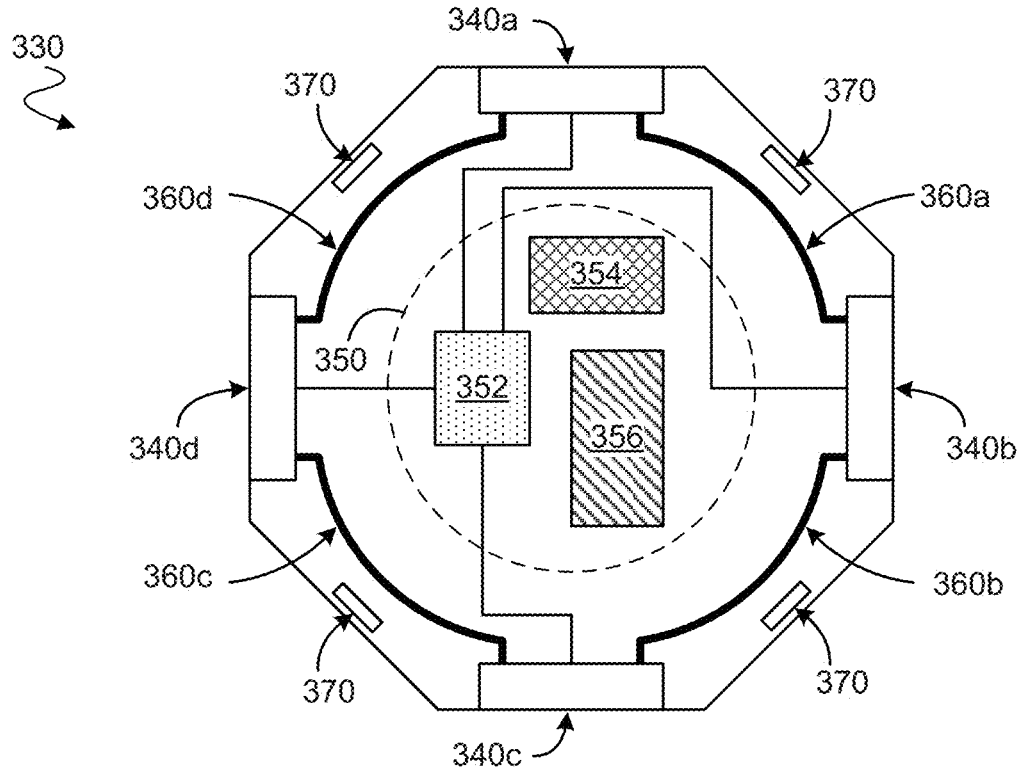
FIG. 3B is a functional block diagram illustrating elements of a device to enable satellite communication according to an embodiment.

FIG. 3B shows a cross-sectional top view of a device 330 to provide satellite communication according to another embodiment. Device 330 may have some or all of the features of device 300, for example. In an embodiment, method 200 includes or otherwise facilitates operation of device 330.

In the illustrative embodiment shown, device 330 includes an antenna panel (not shown) and circuit components 350 (e.g., of circuitry 170) to facilitate operation of the antenna panel. A housing of device 330 may surround the antenna panel, wherein hardware interfaces of device 330 (e.g., including the illustrative interfaces 340*a*, 340*b*, 340*c*, 340*d* shown) are variously disposed each in or on a respective side of the housing. Some or all of interfaces 340*a*, 340*b*, 340*c*, 340*d* may variously provide functionality—such as that of hardware interfaces 166*a*, 166*b*, 166*c*, for example—to enable coupling of device 330 as one module of an antenna assembly.

Circuitry 350 may include, for example, some or all of a block up converter (BUC), down converter (such as a low-noise block, or "LNB," downconverter), encoder, decoder, modulator, demodulator, control logic, modem circuitry (for wired communication and/or wireless communication), memory resources and/or the like. For example, a BUC and/or a LNB converter—e.g., the illustrative converter logic 356 shown—may be coupled to the antenna panel via a waveguide structure (not shown). In such an embodiment, converter logic 356 may be coupled to a modulation and/or demodulation module (e.g., the illustrative modulation logic 354 shown) which is to provide at least in part a conversion between an analog communication format and a digital communication format.

One or more operations of device 300 may be controlled by circuitry such as the illustrative controller 352 shown. Such one or more operations may include, but are not limited to, a tuning of a communication frequency and/or a steering of a transmit or receive functionality provided at a given antenna panel. Alternatively or in addition, such one or more operations may include configuring an operational mode of device 330 in response to command signals from the vehicle, communication of device state back to the vehicle, detecting the presence of a mobile device with which wireless communications may be performed, etc. The circuitry 350 and antenna panel may be variously located in a housing which, for example, forms recesses 370 (or other such mounting structures) to facilitate coupling of device 330 to one or more other similarly configured communication devices.

In an embodiment, some or all of hardware interfaces 340*a*-340*d* are variously coupled to circuitry 350, thereby enabling operation of the antenna panel using signals received via any of multiple different sides of device 330. Alternatively or in addition, device 330 may include one or more pass-through interconnects (such as the illustrative pass-through interconnects 360*a*, 360*b*, 360*c*, 360*d* shown) variously coupled between respective pairs of hardware interfaces. Such pass-through interconnects may each include one or more respective voltage rails, signal lines and/or waveguides which (for example) allow communication device 330 to relay a supply voltage, digital data and/or analog signal. Such relaying may provide the supply voltage, digital data and/or analog signal to another device of the antenna assembly to host circuitry which is coupled to the antenna assembly.

Figure 4:
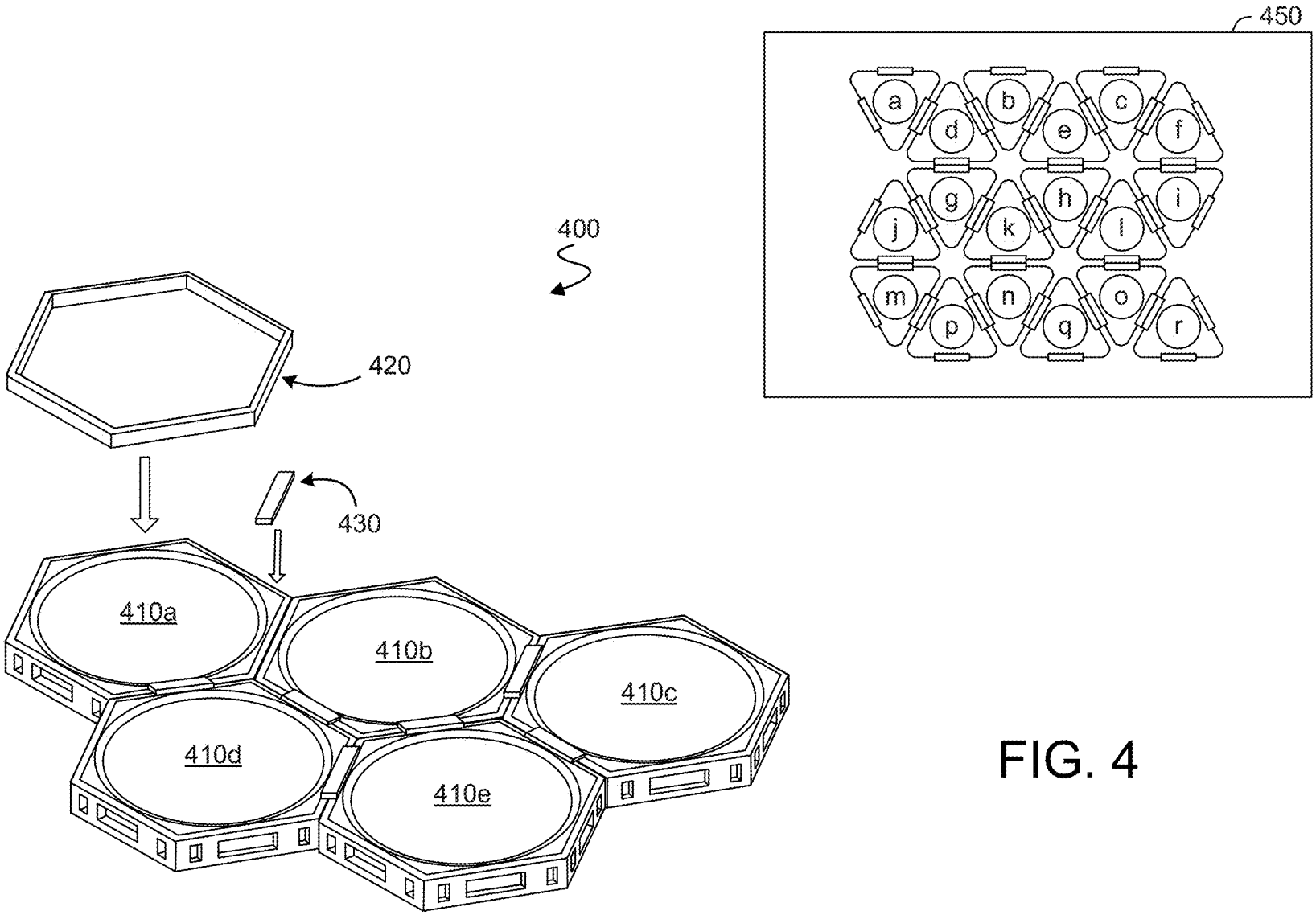
FIG. 4 is a perspective view diagram illustrating elements of an antenna assembly to participate in a communication via satellite according to an embodiment.

FIG. 4 illustrates elements of an assembly 400 of interconnected modular communication devices according to an embodiment. Assembly 400 may include features of assembly 110, for example. In an embodiment, some or all of method 200 includes or otherwise enables operation of assembly 400.

Assembly 400 comprises multiple communication devices (e.g., including the illustrative devices 410*a*, 410*b*, 410*c*, 410*d*, 410*e* shown), some or all of which may each include features of one of devices 160, 300, 330, for example. By way of illustration and not limitation, devices 410*a*-410*e* may each have a respective cross-sectional profile which conforms to a hexagon—e.g., wherein respective configurations of devices 410*a*-410*e* facilitate coupling in an arrangement other than a rectilinear array. Assembly 100 may enable further coupling to circuit logic (not shown)—e.g., including circuitry 130—for providing one or more supply voltages to power satellite communications using devices 410*a*-410*e*.

For example, pairs of devices 410*a*-410*e* may be variously aligned with one another—e.g., each pair in a respective side-by-side configuration. For each of some or all such pairs, the communication devices thereof may be coupled to one another—e.g., directly by respective hardware interfaces or, alternatively, via a flexible extension connector, an adapter or other such interconnect hardware. An interconnect (not shown) may couple circuitry 130 (for example) to a first device of devices 410*a*-410*e*—e.g., via a path which is independent of any other of devices 410*a*-410*e*. In such an embodiment, the first device may be coupled to function as a relay for power (and in some embodiments, data signals) to be variously provided between the circuit logic and some or all of the others of devices 410*a*-410*e*. In another embodiment, multiple ones of devices 410*a*-410*e*—e.g., all such devices—may each configured to independently couple to circuitry 130 and/or another respective external source of power.

Although some embodiments are not limited in this regard, assembly 400 may further comprise or couple to one or more mounting structures which mechanically support connection of devices 410*a*-410*e* to one another and/or to an adjoining structure. By way of illustration and not limitation, clasps 430 (e.g., to be variously received into recesses 370 or other such structures) may be variously coupled between each between respective housings of a corresponding pair of devices 410*a*-410*e*. Alternatively or in addition, a frame 420 may be positioned around a periphery of one or more devices (e.g., around device 410*a*), wherein frame 420 mechanically supports (and/or improves an aesthetic appearance of) connection between various ones of devices 410*a*-410*e*.

Some embodiments variously provide efficient, flexible and/or scalable arrangements of modular antenna devices which, for example, are relatively low profile and/or low power, as compared to other existing antenna technologies. For example, FIG. 4 also shows features of an assembly 450 according to another embodiment. Assembly 450 may include features of assembly 110—e.g., wherein some or all of devices a-r of assembly 450 each include features of device 150, for example. Assembly 450 is another example of a non-rectilinear arrangement of modular antenna devices which can be variously coupled in any of a variety of configurations.

Figure 5:
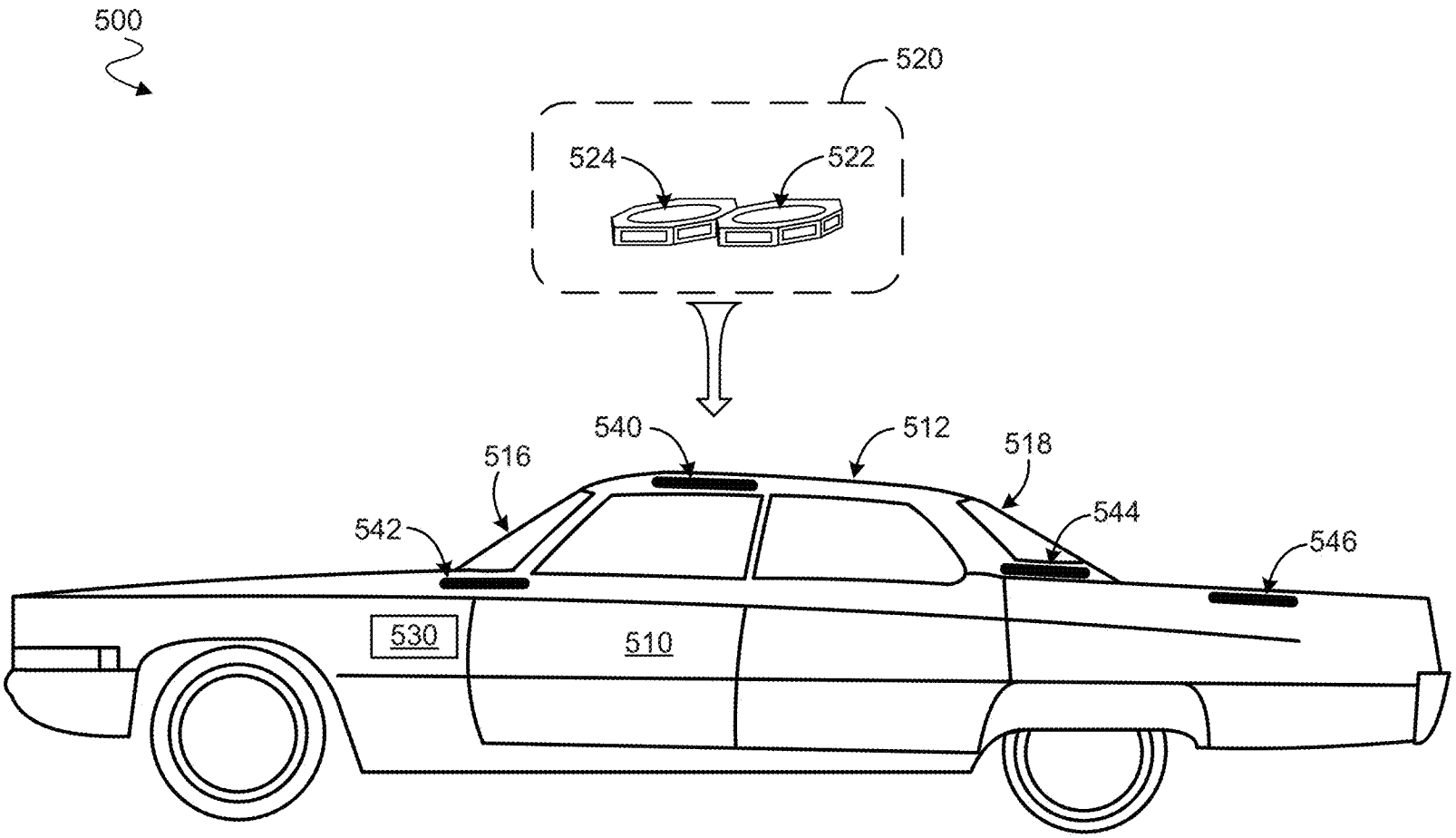
FIG. 5 is a side-view diagram illustrating elements of a system to provide satellite communication according to an embodiment.

Although some embodiments are not limited in this regard, structures of a communication device (e.g., one of devices 122*a*, 122*n*, 150, 160 etc.) may facilitate implementation of an antenna assembly disposed in a motor vehicle such as an automobile (e.g., a car, truck, bus, tractor, etc.), a train or a boat. For example, FIG. 5 illustrates elements of a system 500 to enable satellite communication according to an embodiment. System 500 is just one example of an embodiment wherein communication devices are configured to operate in a motorized vehicle (e.g., based on power which is supplied to the one or more communication devices by the vehicle) as an antenna assembly enabling communication with an in-orbit satellite.

System 500 may comprise a vehicle 510 (in the illustrative embodiment shown, a car) having disposed therein an antenna assembly 520 comprising one or more communication devices, such as the illustrative communication devices 522, 524 shown. Antenna assembly 520 may include features of one of assemblies 110, 400, 450, for example.

Vehicle 510 may include or be coupled to circuitry 530 that is configured to facilitate operation with assembly 520. For example, circuitry 530 may include a power source (e.g., providing 12V DC) to provide a supply voltage to assembly 520. Alternatively or in addition, circuitry 530 may communicate signals representing data received from a satellite, signals representing data to be sent to a satellite, signals to configure assembly 520, signals to indicate an operating condition of assembly 520 and/or the like.

In one embodiment, assembly 520 is located under an exterior surface of a roof portion 512 of vehicle 510. However, assembly 520 may instead be located at any of a variety of other locations of device 510 (e.g., between an interior surface of vehicle 510 and an exterior surface of vehicle 510). By way of illustration and not limitation, an antenna assembly may be located at a region 542 which is on or under a front dashboard which, in turn, is under a front windshield 516 of vehicle 510. Alternatively or in addition, an antenna assembly may be located at a region 544 which is on or under a rear dashboard which, in turn, is under a rear windshield 518 of vehicle 510. In various embodiments, an antenna assembly may additionally or alternatively be located in a region 546 under a trunk lid of vehicle 510. Although some embodiments are not limited in this regard, system 500 may further comprise one or more additional communication devices (not shown) variously located in vehicle 500, where one or more additional antenna assemblies are to participate in satellite communicates in combination with communication assembly 520.

Assembly 520 is one example of an embodiment comprising low-profile structures that support satellite communication. For example, communication devices 522, 524 may each include a respective housing and an antenna panel including one or more holographic antenna elements disposed in a volume that is defined at least in part by such a housing. Respective hardware interfaces may facilitate coupling of communication devices 522, 524 to each other and to circuitry 530. For one or each of communication devices 522, 524, a housing of the device may span a thickness, along a first line of direction, of not more than 5.0 inches (e.g., wherein the thickness is equal to or less than 4.0 inches). In such an embodiment, the housing may span a cross-sectional area—in a plane that is orthogonal to the first line of direction—of at least 30 square inches (e.g., wherein the cross-sectional area is equal to or more than 50 square inches).

Figure 6A:
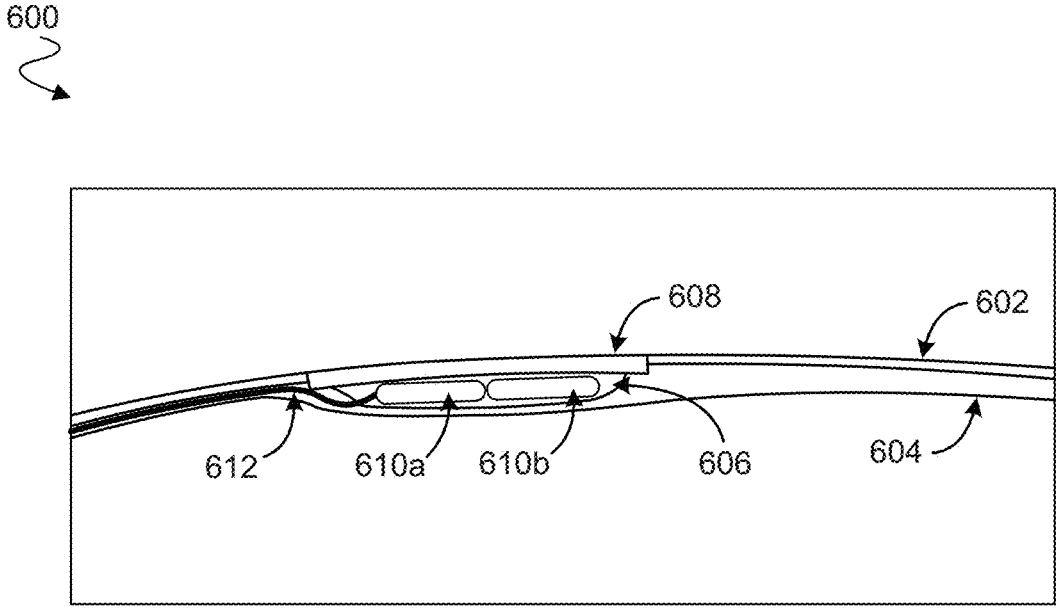
FIGS. 6A, 6B are cross-sectional diagrams each illustrating elements of respective communication system according to a corresponding embodiment.

FIG. 6A shows, in a cut-away view, features of a system 600 to provide satellite communication according to an embodiment. System 600 may include some or all of the features of system 500, for example. In one illustrative embodiment, some or all of method 200 includes or otherwise provides for operation of system 600.

System 600 may include a vehicle and one or more communication devices having, for example, features of one of devices 120*a*, 120*n*, 150, 160, 300, 330, etc.—located between an exterior surface 602 of the vehicle and an interior surface 604 of the vehicle. For example, a roof structure and a liner of the vehicle may form surfaces 602, 604, respectively—e.g., wherein a windshield of the vehicle adjoins the roof structure. One or more communication devices (e.g., including modular devices 610*a*, 610*b* of an antenna assembly) may be positioned in or under a recess 606 which extends at least in part past the exterior surface 602. In such an embodiment, antenna panels of modular devices 610*a*, 610*b* may face out from recess 606 through respective aperture structures. In such an embodiment, a radome structure 608 may be inserted into recess 606 to provide protection to modular devices 610*a*, 610*b*, wherein the radome structure is at least partially transparent to signals communicated between modular devices 610*a*, 610*b* and a remote satellite. An interconnect 612 may be coupled between the antenna assembly and circuitry of the vehicle (not shown) that is to provide power for operating modular devices 610*a*, 610*b*. Interconnect 612 may be hidden from view behind a liner structure of the vehicle.

Figure 6B:
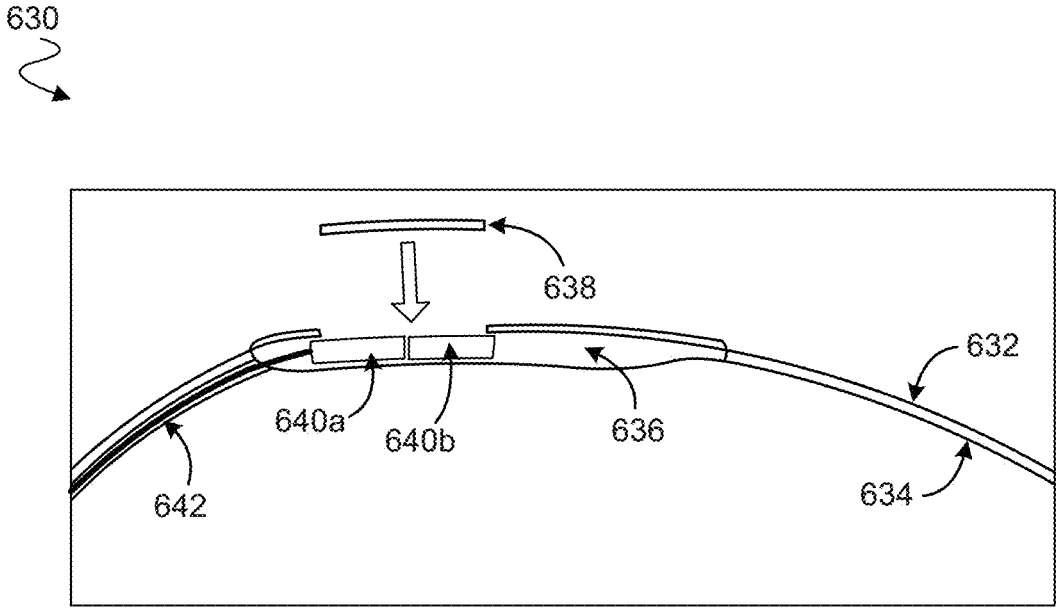

FIG. 6B shows, in a cross-sectional side view, features of a system 630 to provide satellite communication according to another embodiment. System 630 may include some or all of the features of system 500, for example. In one illustrative embodiment, some or all of method 200 includes or otherwise provides for operation of system 630.

System 630 may include a vehicle and an antenna assembly (e.g., comprising the illustrative modular devices 640*a*, 640*b* shown) located between an exterior surface 632 of the vehicle and an interior surface 634 of the vehicle—e.g., wherein a roof and a liner of the vehicle form surfaces 632, 634, respectively. Modular devices 640*a*, 640*b* may be positioned in or under a recess 636 which extends at least in part into the exterior surface 632. In such an embodiment, modular devices 640*a*, 640*b* may be positioned to communicate (e.g., transmit and/or receive) signals with a remote satellite through a curved plane to which exterior surface 632 conforms. For example, such signals may propagate through a radome 638 that covers recess 636 and modular devices 640*a*, 640*b* at least in part. In some embodiments, an interconnect 642 couples modular devices 640*a*, 640*b* to a power supply (not shown) of the vehicle—e.g., wherein interconnect 642 extends along a door frame, windshield post and/or other structure of a vehicle body. The interconnect 642 may be hidden from view behind a liner structure of the vehicle.

Figure 7A:
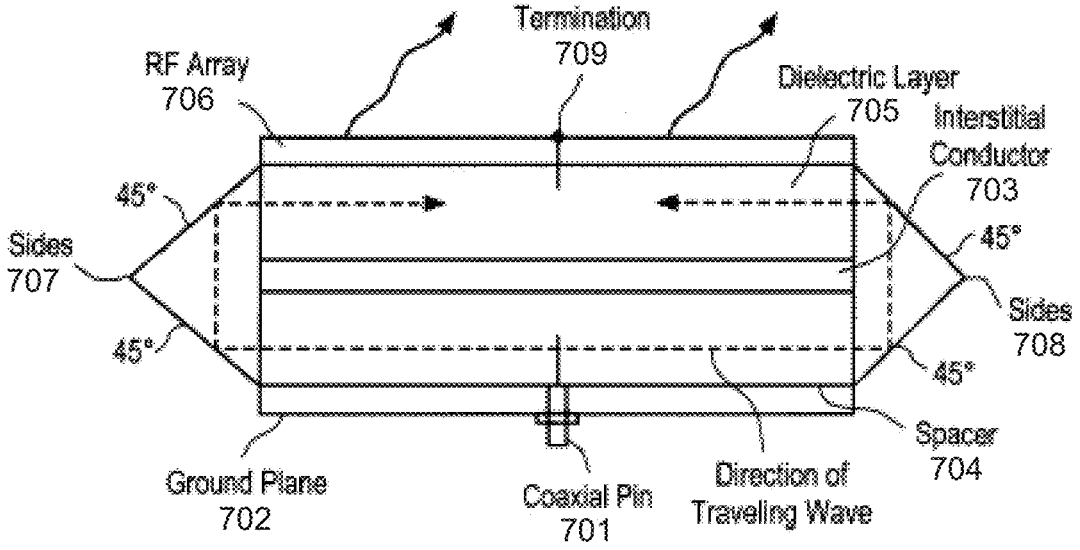
FIGS. 7A and 7B illustrate side views of respective cylindrically fed antenna structures each according to a corresponding embodiment.

FIG. 7A illustrates a side view of a cylindrically fed antenna structure to enable satellite communication according to an embodiment. One of antenna panels 112*a*, 122*n*, 154, 170, 310 etc. may include the antenna structure shown in FIG. 7A, for example. The antenna may produce an inwardly travelling wave using a double layer feed structure (i.e., two layers of a feed structure). In one embodiment, the antenna includes a circular outer shape, though this is not required. That is, non-circular inward travelling structures may be used.

Referring to FIG. 7A, a coaxial pin 701 may be used to excite the field on the lower level of the antenna. In one embodiment, coaxial pin 701 is a 500 coax pin. Coaxial pin 701 may be coupled (e.g., bolted) to the bottom of the antenna structure, which is conducting ground plane 702.

Figure 12:
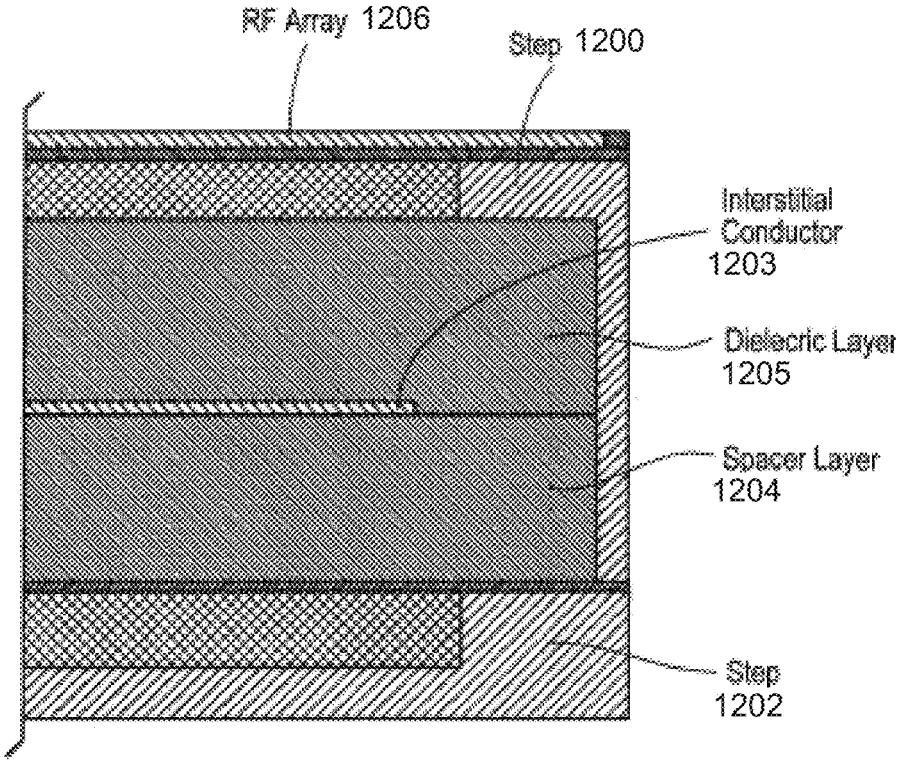
FIG. 12 is a cross-sectional view diagram showing features of an antenna panel to facilitate satellite communication according to an embodiment.

The antenna structure of FIG. 7A may include sides 707 and 708 angled to cause a travelling wave feed from coax pin 701 to be propagated from an area below interstitial conductor 703 (e.g., in a spacer layer 704) to an area above interstitial conductor 703 (e.g., in a dielectric layer 705) via reflection. In one embodiment, the angle of sides 707 and 708 are at 45° angles. In an alternative embodiment, sides 707 and 708 could be replaced with a continuous radius to achieve the reflection. While FIG. 7A shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step such as shown in FIG. 12. Referring to FIG. 12, steps 1200 and 1202 are shown on one end of the antenna around dielectric layer 1205, interstitial conductor 1203, and spacer layer 1204. Step structures similar to steps 1200 and 1202 may also be at the other ends of these layers. An RF array 1206 (e.g., similar in function to RF array 706) may be disposed above dielectric layer 1205.

In operation, when a feed wave is fed in from coaxial pin 701, the wave travels outward concentrically oriented from coaxial pin 701 in the area between ground plane 702 and interstitial conductor 703. The concentrically outgoing waves may be reflected by sides 707 and 708 and travel inwardly in the area between interstitial conductor 703 and RF array 706. The reflection from the edge of the circular perimeter causes the wave to remain in phase (i.e., it is an in-phase reflection). The travelling wave may be slowed by dielectric layer 705. At this point, the travelling wave starts interacting and exciting with elements in RF array 706 to obtain the desired scattering. To terminate the travelling wave, a termination 709 may be included in the antenna at the geometric center of the antenna. In one embodiment, termination 709 comprises a pin termination (e.g., a 50Ω pin). In another embodiment, termination 709 comprises an RF absorber that terminates unused energy to prevent reflections of that unused energy back through the feed structure of the antenna. These could be used at the top of RF array 706.

In one embodiment, a conducting ground plane 702 and interstitial conductor 703 are parallel to each other. A distance between ground plane 702 and interstitial conductor 703 may be in a range of 0.1"-0.15", for example. This distance may be λ2, where λ is the wavelength of the travelling wave at the frequency of operation. In one embodiment, spacer 704 may be a foam or air-like spacer—e.g., comprising a plastic spacer material. One purpose of dielectric layer 705 may be to slow the travelling wave relative to free space velocity. In one embodiment, dielectric layer 705 slows the travelling wave by 30% relative to free space. In one embodiment, the range of indices of refraction that are suitable for beam forming are 1.2-1.8, where free space has by definition an index of refraction equal to 1. A material with distributed structures may be used as dielectric 705, such as periodic sub-wavelength metallic structures that may be machined or lithographically defined, for example. An RF-array 706 may be on top of dielectric 705. In one embodiment, the distance between interstitial conductor 703 and RF-array 706 is 0.1"-0.15". In another embodiment, this distance may be $\lambda_{eff}/2$, where $\lambda_{eff}$ is the effective wavelength in the medium at the design frequency.

Figure 7B:
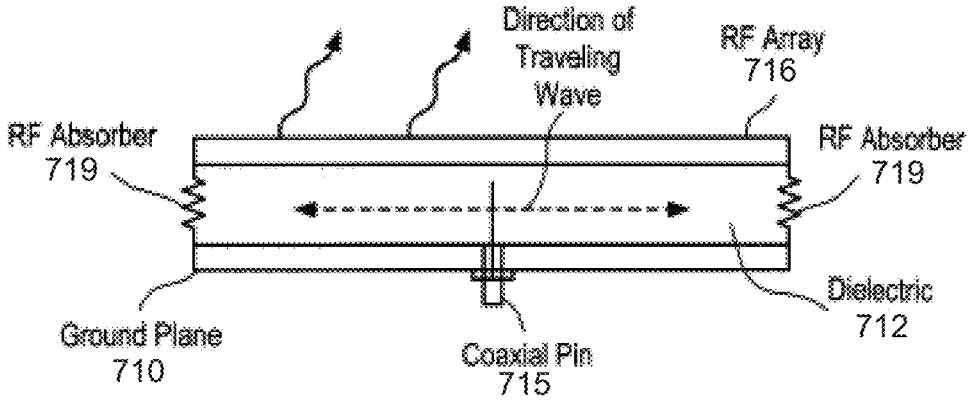

FIG. 7B illustrates another example of an antenna structure that is provided by a communication device according to an embodiment. Such an antenna structure may be included in one of antenna panels 112*a*, 122*n*, 154, 170, 310 etc., for example. Referring to FIG. 7B, a ground plane 710 may be substantially parallel to a dielectric layer 712 (e.g., a plastic layer, etc.). RF absorbers 719 (e.g., resistors) couple the ground plane 710 to a RF array 716 disposed on dielectric layer 712. A coaxial pin 715 (e.g., 50Ω) feeds the antenna.

In operation, a feed wave is fed through coaxial pin 715 and travels concentrically outward and interacts with the elements of RF array 716. The cylindrical feed in both the antennas of FIGS. 7A and 7B improves the service angle of the antenna. Instead of a service angle of plus or minus forty five degrees azimuth (±45° Az) and plus or minus twenty five degrees elevation (±25° El), in one embodiment, the antenna system has a service angle of seventy five degrees (75°) from the bore sight in all directions. As with any beam forming antenna comprised of many individual radiators, the overall antenna gain is dependent on the gain of the constituent elements, which themselves may be angle-dependent. When using common radiating elements, the overall antenna gain typically decreases as the beam is pointed further off bore sight. At 75° off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

RF array 706 of FIG. 7A and/or RF array 716 of FIG. 7B may each include a respective wave scattering subsystem that includes a group of patch antennas (i.e., scatterers) that act as radiators. This group of patch antennas may comprise an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) may be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped to improve responsiveness so that a seven millisecond (7 ms) requirement may be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave. The phase of the electromagnetic wave generated by a single CELC may be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty five degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Figure 8:
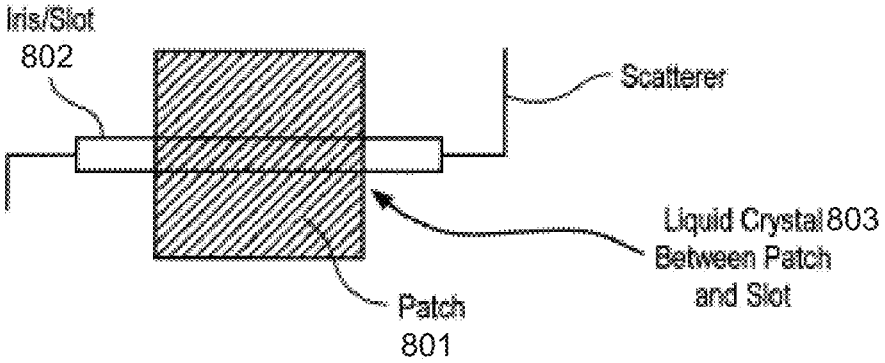
FIG. 8 is a top view of an antenna panel of a communication device according to an embodiment.

FIG. 8 illustrates a top view a patch antenna, or scattering element, which may be a component of a communication device according to another embodiment. Such a patch antenna, or scattering element, may be included in one of antenna panels 112*a*, 122*n*, 154, 170, 310 etc., for example. Referring to FIG. 8, the patch antenna may comprise a patch 801 collocated over a slot 802 with liquid crystal (LC) 803 in between patch 801 and slot 802.

Figure 9:
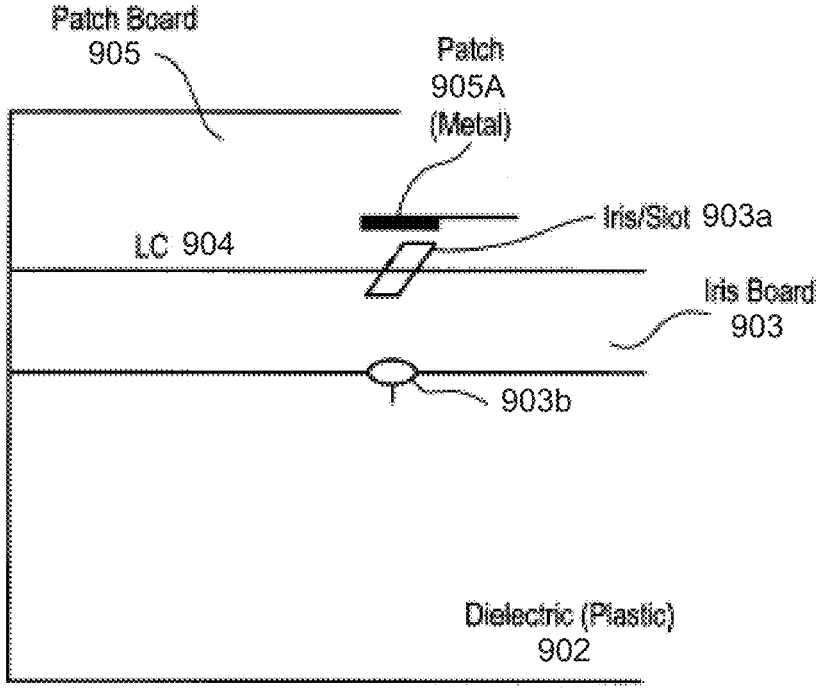
FIG. 9 is a side view diagram showing features of an antenna panel to facilitate satellite communication according to an embodiment.

FIG. 9 illustrates a side view of a patch antenna that is part of a cyclically fed antenna system according to an embodiment. One of antenna panels 112*a*, 122*n*, 154, 170, 310 etc. (for example) may include the cyclically fed antenna system shown in FIG. 9.

Referring to FIG. 9, the patch antenna may be above dielectric 902 (e.g., a plastic insert, etc.) that, for example, is above the interstitial conductor 703 of FIG. 7A (or a ground conductor such as in the case of the antenna in FIG. 7B). An iris board 903 may comprise a ground plane (conductor) with a number of slots, such as slot 903*a* on top of and over dielectric 902. Below slot 903*a* is a corresponding circular opening 903*b*. A slot may be referred to herein as an iris. In one embodiment, the slots in iris board 903 are created by etching. Note that in one embodiment, the highest density of slots, or the cells of which they are a part, is $\lambda/2$. In one embodiment, the density of slots/cells is $\lambda/3$ (i.e., 3 cells per $\lambda$). Note that other densities of cells may be used.

A patch board 905 containing a number of patches, such as patch 905*a*, may be located over the iris board 903, separated by an intermediate dielectric layer. Each of the patches, such as patch 905*a*, may be co-located with one of the slots in iris board 903. In one embodiment, the intermediate dielectric layer between iris board 903 and patch board 905 is a liquid crystal substrate layer 904. The liquid crystal acts as a dielectric layer between each patch and its co-located slot. Note that substrate layers other than LC may be used. In one embodiment, patch board 905 comprises a printed circuit board (PCB), and each patch comprises metal on the PCB, where the metal around the patch has been removed. In one embodiment, patch board 905 includes vias for each patch that is on the side of the patch board opposite the side where the patch faces its co-located slot. The vias are used to connect one or more traces to a patch to provide voltage to the patch. In one embodiment, matrix drive is used to apply voltage to the patches to control them. The voltage is used to tune or detune individual elements to effectuate beam forming.

Figure 10:
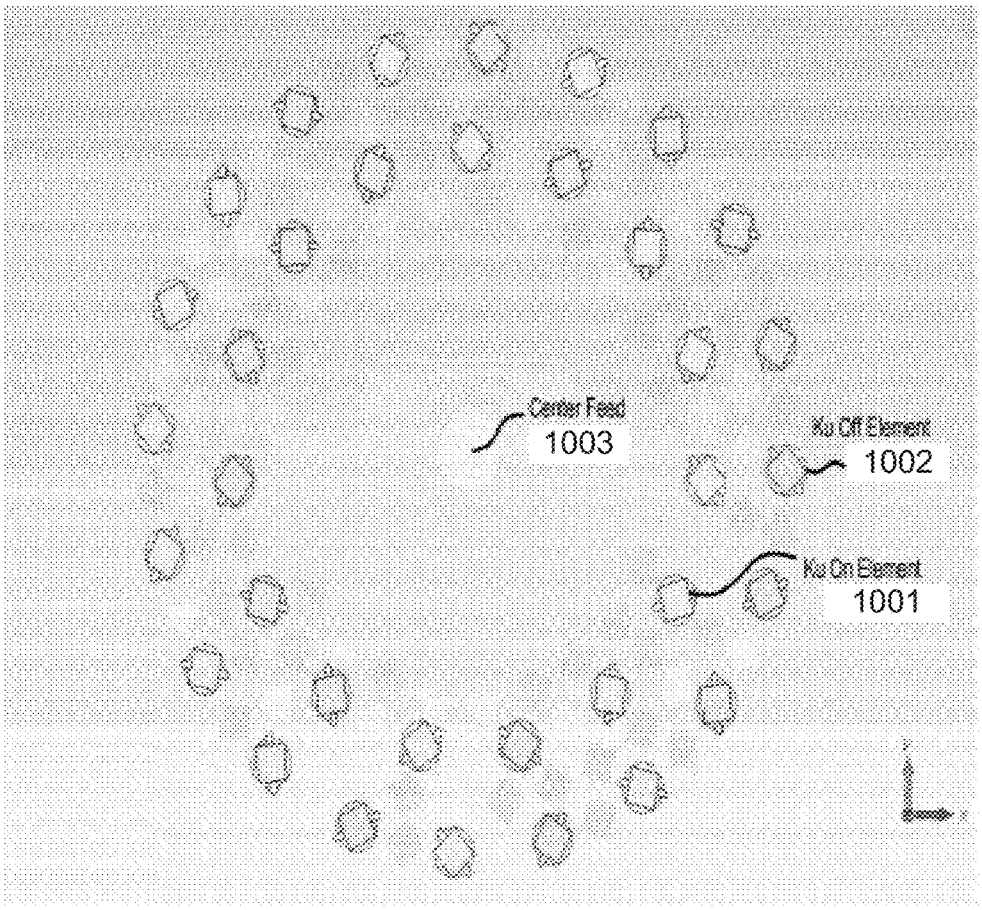
FIG. 10 is a top view diagram showing features of an antenna panel to facilitate satellite communication according to an embodiment.

FIG. 10 illustrates a dual reception antenna showing receive antenna elements of a communication device according to an embodiment. One of antenna panels 112*a*, 122*n*, 154, 170, 310 etc. (for example) may include an arrangement of antenna elements such as that shown in FIG. 10. In an embodiment, a dual receive antenna is a Ku receive-Ka receive antenna. Referring to FIG. 10, a slotted array of Ku antenna elements is shown. A number of Ku antenna elements are shown either off or on. For example, the aperture shows Ku on element 1001 and Ku off element 1002. Also shown in the aperture layout is center feed 1003. Also, as shown, in one embodiment, the Ku antenna elements are positioned or located in circular rings around center feed 1003 and each includes a slot with a patch co-located over the slot. In one embodiment, each of the slot slots is oriented either +45 degrees or −45 degrees relative to the cylindrical feed wave emanating from center feed 1003 and impinging at a central location of each slot.

Figure 11:
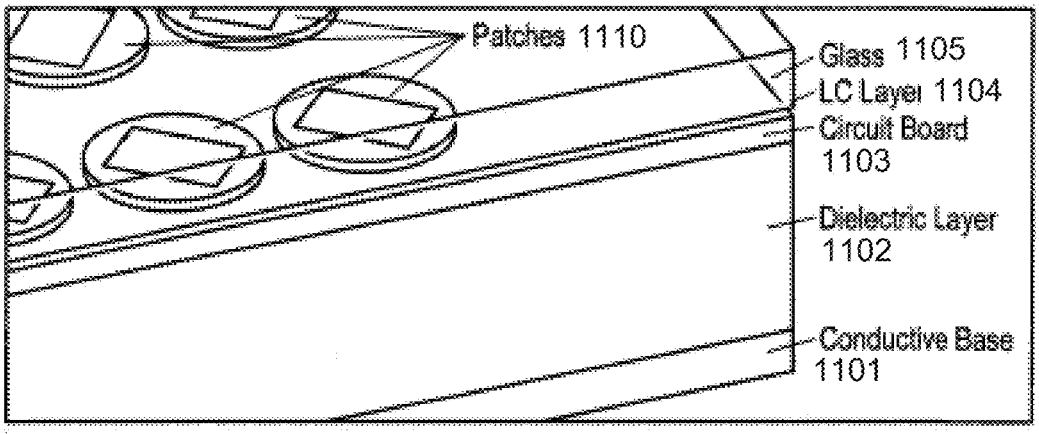
FIG. 11 is a perspective view showing features of an antenna panel to facilitate satellite communication according to an embodiment.

In one embodiment, patches may be deposited on a glass layer (e.g., a glass typically used for LC displays (LCDs) such as, for example, Corning Eagle glass), instead of using a circuit patch board. FIG. 11 illustrates a portion of a cylindrically fed antenna that includes a glass layer that contains the patches. One of antenna panels 112*a*, 122*n*, 154, 170, 310 etc. (for example) may include the cyclically fed antenna of FIG. 11.

Referring to FIG. 11, the antenna includes conductive base or ground layer 1101, dielectric layer 1102 (e.g., plastic), iris board 1103 (e.g., a circuit board) containing slots, a liquid crystal substrate layer 1104, and a glass layer 1105 containing patches 1110. In one embodiment, the patches 1110 have a rectangular shape. In one embodiment, the slots and patches are positioned in rows and columns, and the orientation of patches is the same for each row or column while the orientation of the co-located slots are oriented the same with respect to each other for rows or columns, respectively.

Figure 13:
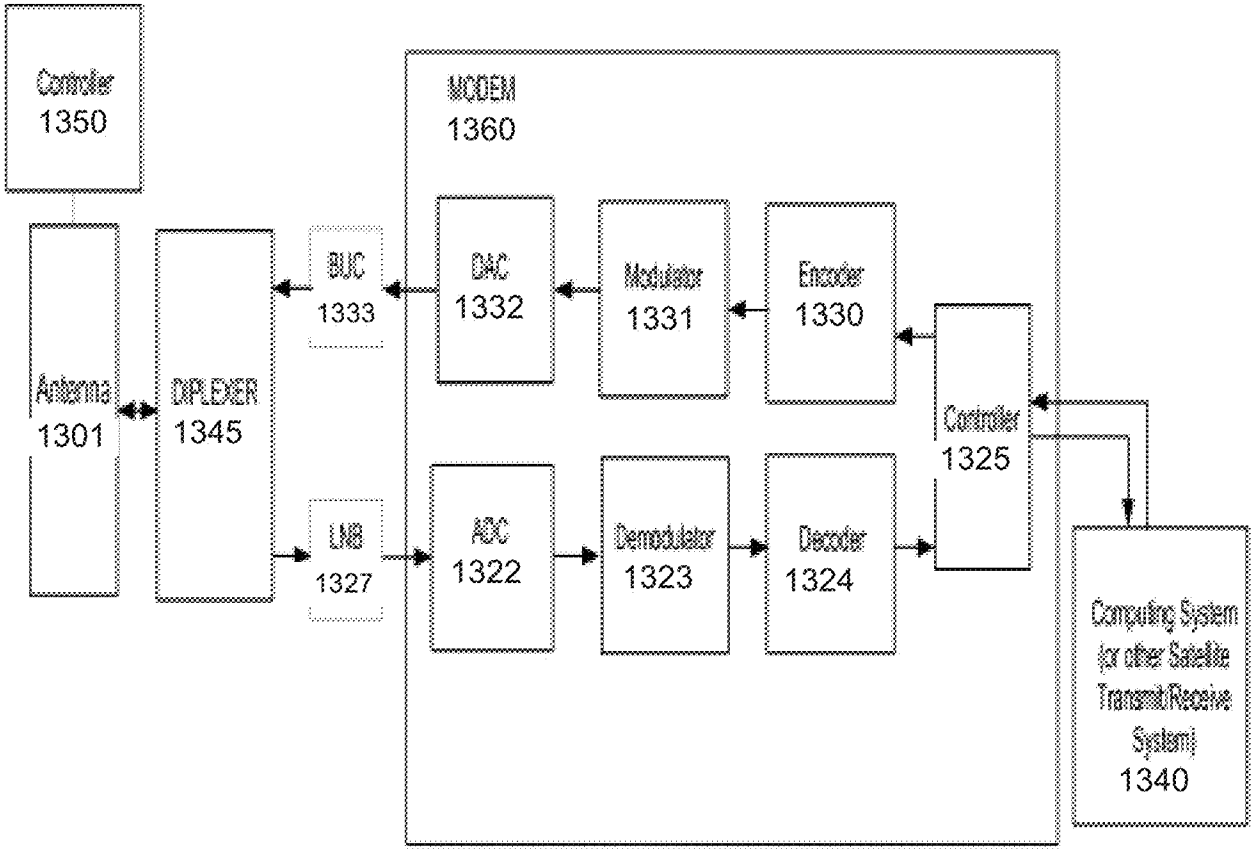
FIG. 13 is a block diagram illustrating features of a communication system according to an embodiment.

FIG. 13 is a block diagram of a communication system having transmit and receive paths according to an embodiment. The communication system of FIG. 13 may include features of system 100, for example. For example, the communication system may include one of antenna assemblies 110, 400, 450, 520. While one transmit path and one receive path are shown, the communication system may include only one of a receive path and a transmit path or, alternatively, may include more than one transmit path and/or more than one receive path.

Referring to FIG. 13, antenna 1301 includes one or more antenna panels operable to transmit and receive satellite communications—e.g., simultaneously at different respective frequencies. In one embodiment, antenna 1301 is coupled to diplexer 1345. The coupling may be by one or more feeding networks. In the case of a radial feed antenna, diplexer 1345 may combine the two signals—e.g., wherein a connection between antenna 1301 and diplexer 1345 includes a single broad-band feeding network that can carry both frequencies.

Diplexer 1345 may be coupled to a low noise block down converter (LNBs) 1327 to perform a noise filtering function and a down conversion and amplification function—e.g., including operations adapted from techniques known in the art. In one embodiment, LNB 1327 is in an out-door unit (ODU). In another embodiment, LNB 1327 is integrated into the antenna apparatus. LNB 1327 may be coupled to a modem 1360, which may be further coupled to computing system 1340 (e.g., a computer system, modem, etc.).

Modem 1360 may include an analog-to-digital converter (ADC) 1322, which may be coupled to LNB 1327, to convert the received signal output from diplexer 1345 into digital format. Once converted to digital format, the signal may be demodulated by demodulator 1323 and decoded by decoder 1324 to obtain the encoded data on the received wave. The decoded data may then be sent to controller 1325, which sends it to computing system 1340.

Modem 1360 may additionally or alternatively include an encoder 1330 that encodes data to be transmitted from computing system 1340. The encoded data may be modulated by modulator 1331 and then converted to analog by digital-to-analog converter (DAC) 1332. The analog signal may then be filtered by a BUC (up-convert and high pass amplifier) 1333 and provided to one port of diplexer 1333. In one embodiment, BUC 1333 is in an out-door unit (ODU). Diplexer 1345 may support operations adapted from conventional interconnect techniques to provide the transmit signal to antenna 1301 for transmission.

Controller 1350 may control antenna 1301, including controller 1350 transmitting signals to configure beam steering, beamforming, frequency tuning and/or other operational characteristics of one or more antenna elements. Note that the full duplex communication system shown in FIG. 13 has a number of applications, including but not limited to, internet communication, vehicle communication (including software updating), etc.

Techniques and architectures for providing a modular assembly of antenna devices are described herein. In the above description, for purposes of explanation, numerous specific details are set forth in order to provide a thorough understanding of certain embodiments. It will be apparent, however, to one skilled in the art that certain embodiments can be practiced without these specific details. In other instances, structures and devices are shown in block diagram form in order to avoid obscuring the description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the detailed description herein are presented in terms of algorithms and symbolic representations of operations on data bits within a computer memory. These algorithmic descriptions and representations are the means used by those skilled in the computing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Certain embodiments also relate to apparatus for performing the operations herein. This apparatus may be specially constructed for the required purposes, or it may comprise a general purpose computer selectively activated or reconfigured by a computer program stored in the computer. Such a computer program may be stored in a non-transitory computer readable storage medium, such as, but is not limited to, any type of disk including floppy disks, optical disks, CD-ROMs, and magnetic-optical disks, read-only memories (ROMs), random access memories (RAMs) such as dynamic RAM (DRAM), EPROMs, EEPROMs, magnetic or optical cards, or any type of media suitable for storing electronic instructions, and coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description herein. In addition, certain embodiments are not described with reference to any particular programming language. It will be appreciated that a variety of programming languages may be used to implement the teachings of such embodiments as described herein.

Besides what is described herein, various modifications may be made to the disclosed embodiments and implementations thereof without departing from their scope. Therefore, the illustrations and examples herein should be construed in an illustrative, and not a restrictive sense. The scope of the invention should be measured solely by reference to the claims that follow.

What is claimed is:

1. A communication device for coupling to first and second interconnected and similarly-configured communication devices adjacent to the communication device, the communication device comprising:

a housing extending around a volume, wherein a cross-sectional profile of the housing conforms to a polygon other than any rectangle;

an antenna panel disposed in the volume, the antenna panel including one or more antenna elements for a beam forming antenna configured to participate in a communication via a top of the communication device;

hardware interfaces each disposed on a respective side of the housing, the hardware interfaces to couple the communication device to a power supply and at least two different hardware interfaces of the hardware interfaces for coupling to corresponding hardware interfaces at one side of a housing of each of the first and second interconnected communication devices;

one or more pass through-interconnects each coupled between a respective pair of the hardware interfaces, at least one of the one or more pass through-interconnects for relaying signals between sides of the first and second adjacent interconnected and similarly-configured communication devices in a side-by-side configuration, wherein the at least one of the one or more pass through-interconnects includes a waveguide for relaying signals between the sides of the first and second adjacent interconnected and similarly-configured communication devices in the side-by-side configuration, the hardware interfaces of the first and second adjacent interconnected and similarly-configured communication devices in the side-by-side configuration being reciprocal to hardware interfaces of the communication device; and control logic comprising circuitry within the housing and coupled to operate the antenna panel based on a voltage provided by the power supply.

2. The communication device of claim 1, wherein the polygon is a hexagon.

3. The communication device of claim 1, wherein the polygon is a triangle.

4. The communication device of claim 1, the hardware interfaces including a universal serial bus connector to couple to the power supply.

5. The communication device of claim 1, wherein the one or more antenna elements to participate in the communication includes the one or more antenna elements to perform a full duplex signal exchange.

6. The communication device of claim 1, wherein the hardware interfaces are each disposed in or on a respective side of the housing other than the first side.

7. The communication device of claim 1, wherein a thickness of the housing along a first line of direction is equal to or less than five inches, wherein the first line of direction is orthogonal to a portion of the first side.

8. The communication device of claim 1, wherein the one or more antenna elements to participate in the communication includes the one or more antenna elements to transmit or receive a signal including a frequency greater than 7.5 GigaHertz.

9. The communication device of claim 1, further comprising a wireless modem to communicate wirelessly with a device other than a satellite.

10. A system comprising:

an antenna assembly including a plurality of interconnected and similarly-configured communication devices comprising a first communication device, wherein, for each of the plurality of interconnected communication devices, the communication device includes:

a housing extending around a volume, wherein a cross-sectional profile of the housing conforms to a polygon other than any rectangle;

an antenna panel disposed in the volume, the antenna panel including one or more antenna elements for beam forming;

hardware interfaces each disposed on a respective side of the housing, first and second of the hardware interfaces coupled to corresponding hardware interfaces at one side of a housing of each of first and second interconnected communication devices, respectively, adjacent to the first and second hardware interfaces, the first and second hardware interfaces being different; and control logic comprising circuitry within the housing and coupled to operate the antenna panel;

wherein the hardware interfaces of the first communication device are configured to couple the antenna assembly to a power supply;

one or more pass through-interconnects each coupled between a respective pair of the hardware interfaces of the first communication device, at least one of the one or more pass through-interconnects for relaying one or more signals between sides of the first and second adjacent interconnected and similarly-configured communication devices in a side-by-side configuration, wherein the at least one of the one or more pass through-interconnects includes a waveguide for relaying signals between the sides of the first and second adjacent interconnected and similarly-configured communication devices in the side-by-side configuration, the hardware interfaces of the first and second adjacent interconnected and similarly-configured communication devices in the side-by-side configuration being reciprocal to hardware interfaces of the communication device; and wherein the respective antenna panels of the plurality of communication devices are each to participate in a communication based on a voltage provided by the power supply.

11. The system of claim 10, wherein the respective housings of the plurality of communication devices each conform to a hexagon.

12. The system of claim 10, wherein the respective housings of the plurality of communication devices each conform to a triangle.

13. The system of claim 10, the hardware interfaces of the first communication device including a universal serial bus connector to couple to the power supply.

14. The system of claim 10, wherein the respective antenna panels of the plurality of communication devices to participate in the communication includes the respective antenna panels of the plurality of communication devices to perform a full duplex signal exchange.

15. The system of claim 10, wherein the antenna panel of the first communication device to participate in the communication via a first side of the first communication device, wherein the hardware interfaces of the first communication device are each disposed in or on a different respective side of the first communication device other than the first side.

16. The system of claim 10, wherein, for each of the plurality of interconnected communication devices, a thickness of the housing of the communication device is equal to or less than five inches.

17. The system of claim 10, wherein the respective antenna panels of the plurality of communication devices to participate in the communication includes the respective antenna panels of the plurality of communication devices to transmit or receive a signal including a frequency greater than 7.5 GigaHertz.

18. The system of claim 10, the first communication device further comprising a wireless modem to communicate wirelessly with a device other than a satellite.

* * * * *